US008657214B2

(12) United States Patent
Matsumura

(10) Patent No.: US 8,657,214 B2
(45) Date of Patent: Feb. 25, 2014

(54) FUEL INJECTION VALVE AND INTERNAL COMBUSTION ENGINE

(75) Inventor: Eriko Matsumura, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 208 days.

(21) Appl. No.: 13/316,905

(22) Filed: Dec. 12, 2011

(65) Prior Publication Data

US 2012/0152205 A1 Jun. 21, 2012

(30) Foreign Application Priority Data

Dec. 21, 2010 (JP) ..... 2010-284942

(51) Int. Cl.
*F02M 61/06* (2006.01)
*B05B 1/34* (2006.01)

(52) U.S. Cl.
USPC ..... 239/533.3; 123/584

(58) Field of Classification Search
USPC ..... 239/533.1–533.12, 584–585.5
See application file for complete search history.

(56) References Cited

U.S. PATENT DOCUMENTS

| | | | | |
|---|---|---|---|---|
| 3,559,892 | A * | 2/1971 | De Luca | 239/533.4 |
| 4,139,158 | A * | 2/1979 | Uchida | 239/533.12 |
| 4,595,144 | A * | 6/1986 | Wiegand et al. | 239/533.3 |
| 5,499,769 | A * | 3/1996 | Namiki et al. | 239/409 |
| 5,540,200 | A * | 7/1996 | Naitoh et al. | 123/299 |
| 6,019,296 | A * | 2/2000 | Yamamoto et al. | 239/533.2 |
| 6,092,741 | A * | 7/2000 | Sumida | 239/408 |
| 6,520,145 | B2 * | 2/2003 | Hunkert | 123/305 |
| 6,698,666 | B2 * | 3/2004 | Ohata et al. | 239/89 |
| 7,017,839 | B2 * | 3/2006 | Heyse | 239/533.12 |
| 2002/0000483 | A1 * | 1/2002 | Shoji et al. | 239/533.2 |
| 2007/0039587 | A1 * | 2/2007 | Sasaki et al. | 123/299 |
| 2007/0181094 | A1 * | 8/2007 | Katou et al. | 123/298 |
| 2010/0070158 | A1 | 3/2010 | Futonagane et al. | |

FOREIGN PATENT DOCUMENTS

| | | |
|---|---|---|
| CN | 101535624 A | 9/2009 |
| JP | A-08-144894 | 6/1996 |
| JP | A-2000-303936 | 10/2000 |
| JP | A-2004-084534 | 3/2004 |
| JP | A-2004-332657 | 11/2004 |
| JP | A-2006-257992 | 9/2006 |
| JP | A-2008-151060 | 7/2008 |
| JP | A-2009-264193 | 11/2009 |

OTHER PUBLICATIONS

Matsumura et al., "Analysis of Fuel Flow and Spray Atomization in Slit Nozzle for Direct Injection SI Gasoline Engines," *SAE Technical Paper Series*, SAE World Congress, Detroit, Michigan Apr. 3-6, 2006.

* cited by examiner

*Primary Examiner* — Thomas Moulis
(74) *Attorney, Agent, or Firm* — Oliff and Berridge, PLC

(57) ABSTRACT

A fuel injection valve includes a valve body and a valve member. The fuel injection valve is configured to control fuel supply by a movement of the valve member relative to the valve body. A slit that is configured to inject fuel having a first end portion opened in a sack portion of the valve body and a second end portion opened at an outer wall of the valve body is formed in the valve body. A through hole having a first end portion opened in the sack portion and a second end portion opened at the outer wall of the valve body is formed in the valve body.

10 Claims, 9 Drawing Sheets

FUEL INJECTION VALVE AND INTERNAL COMBUSTION ENGINE

INCORPORATION BY REFERENCE

The disclosure of Japanese Patent Application No. 2010-284942 filed on Dec. 21, 2010 including the specification, drawings and abstract is incorporated herein by reference in its entirety.

BACKGROUND OF THE INVENTION

1. Field of the Invention

The invention relates to a fuel injection valve that can control the supply of fuel by the movement of a valve member relative to a valve body and to an internal combustion engine provided with such a fuel injection valve.

2. Description of Related Art

In cylinder direct injection type engines in which fuel is directly injected into a combustion chamber deposits (oxides, carbides, decomposition products and the like) inherent to the fuel injected from the fuel injection valve adhere to the injection hole and periphery thereof, thereby decreasing the amount of injected fuel, changing the spray shape, and degrading controllability of combustion.

Using the cavitation of fuel flowing from a sack portion of the fuel injection valve into the injection hole is one of the methods for eliminating the adhesion of deposits to the inner surface of the injection hole. The fuel from the sack portion is throttled in an injection hole inlet of a very small diameter and the fuel pressure rises and immediately thereafter instantaneously falls when the fuel flows into the injection hole. As a result, cavitation is generated. The deposits are prevented from adhering and the adhered deposits are stripped by the energy of shock waves created by the cavitation.

For example, Japanese Patent Application Publication No. 2009-264193 (JP-A-2009-264193) describes the feature of inhibiting the adhesion of deposits by cavitation in a fuel injection valve provided with an injection hole in the form of a flat circular sector-shaped slit nozzle. Further, JP-A-2009-264193 suggests reducing the surface roughness of that portion of the inner surface of the injection hole where cavitation is unlikely to occur or forming a film that inhibits the adhesion of deposits to this portion.

However, the technical features suggested in JP-A-2009-264193 make it difficult for the deposits to adhere, but do not remove the deposits.

SUMMARY OF THE INVENTION

The invention provides a fuel injection valve such that when deposits have adhered to the fuel injection valve, the deposits are removed therefrom, and also an internal combustion engine using such a fuel injection valve.

A first aspect of the invention relates to a fuel injection valve that includes a valve body and a valve member. The fuel injection valve is configured to control fuel supply by a movement of the valve member relative to the valve body. A slit that is configured to inject fuel having a first end portion opened in a sack portion of the valve body and a second end portion opened at an outer wall of the valve body is formed in the valve body. A through hole having a first end portion opened in the sack portion and a second end portion opened at the outer wall of the valve body is formed in the valve body.

According to the abovementioned aspect, there are provided a slit having a first end portion opened in a sack portion of the valve body and a second end portion opened at an outer wall of the valve body and a through hole having a first end portion opened in the sack portion and a second end portion opened at the outer wall of the valve body. Therefore, even when cavitation is unlikely to occur in the slit, a negative pressure generated inside the sack portion can be introduced via the through hole into the injection hole. As a result, even when deposits have adhered to the fuel injection valve, the deposits can be removed from the fuel injection valve. Furthermore, formation of deposits on the fuel injection valve can be inhibited.

A second aspect of the invention relates to an internal combustion engine that includes the fuel injection valve according to the above first aspect.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
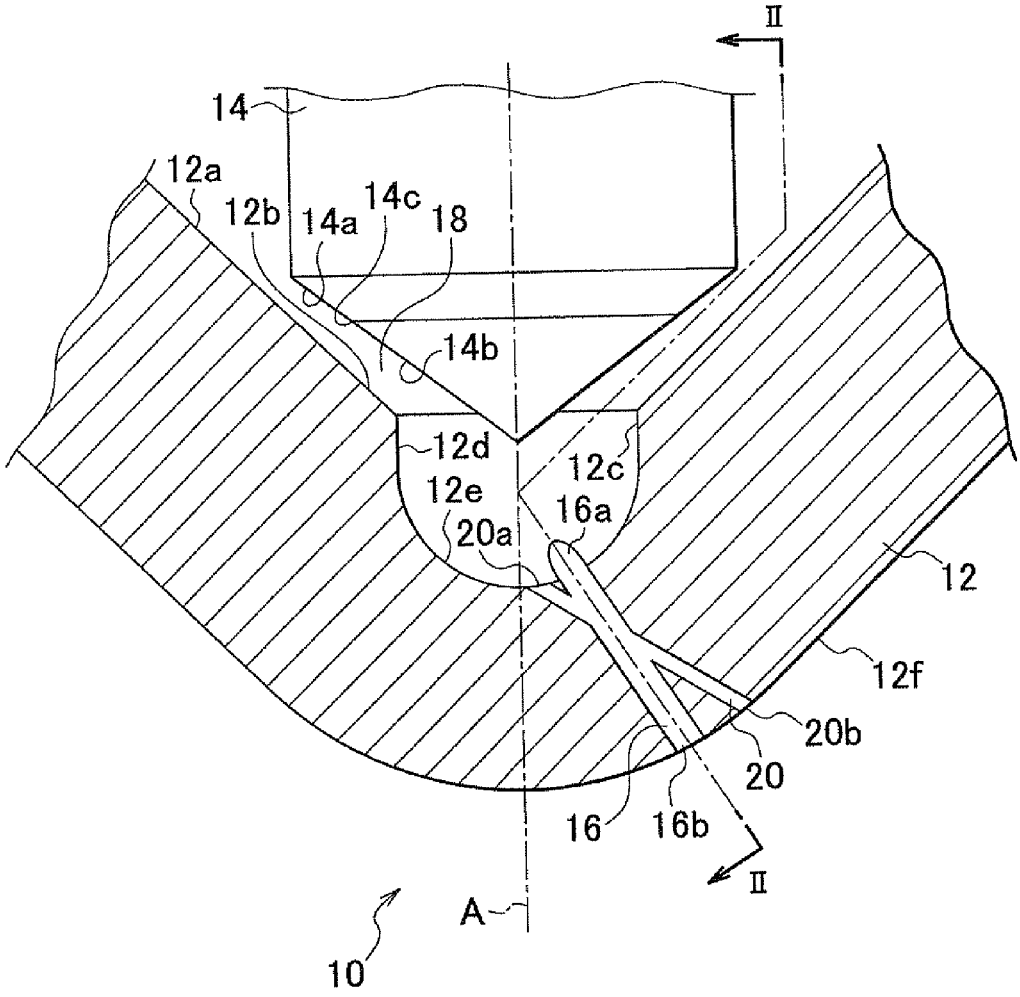
FIG. 1 is a schematic diagram of the distal end portion of the fuel injection valve according to one embodiment of the invention; this figure shows a cross section of valve body.
Figure 2:
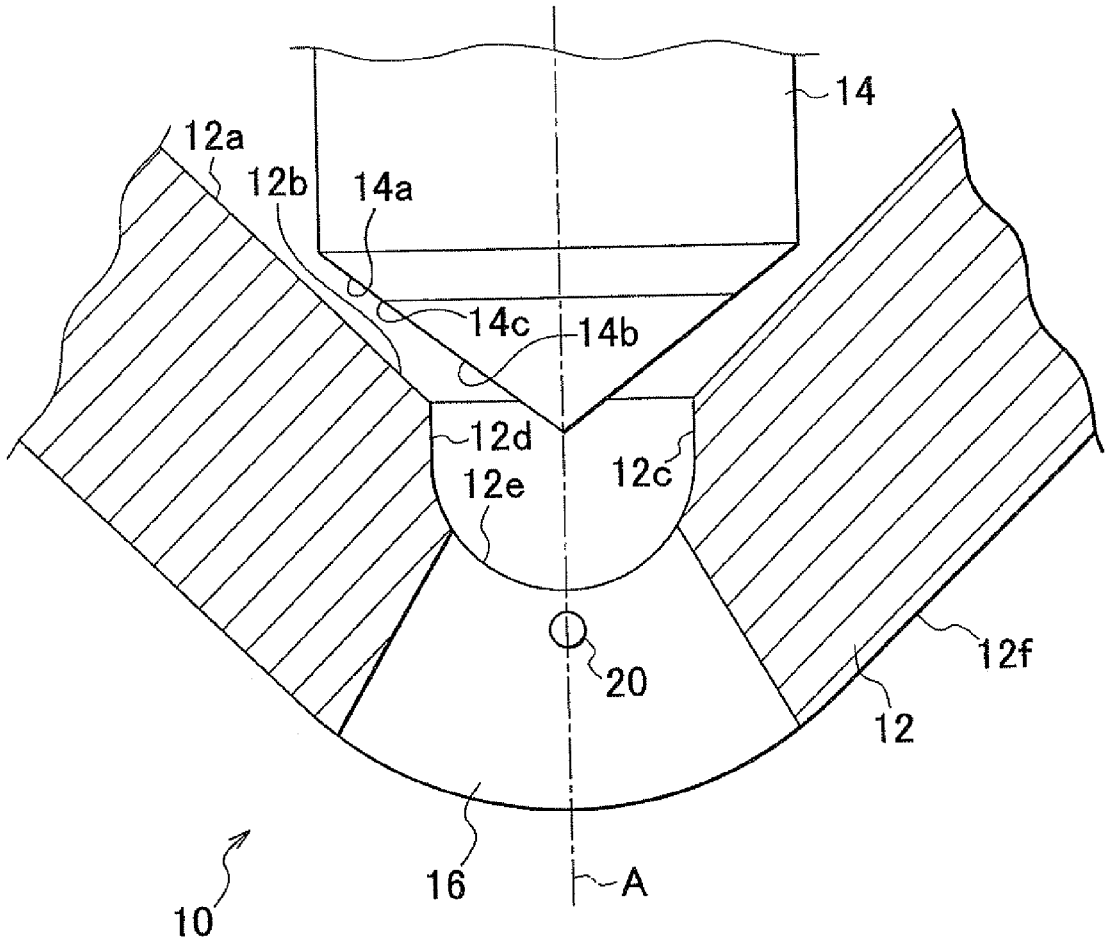
FIG. 2 is a schematic view of the fuel injection valve shown in FIG. 1 that is taken along the II-II line of FIG. 1.

An embodiment of the invention will be explained below with reference to the appended drawings. FIGS. 1 and 2 are across-sectional schematic views of the distal end portion of the fuel injection valve 10 according to one embodiment of the invention. The fuel injection valve 10 is an injector for cylinder injection that serves to inject fuel directly into the combustion chamber of an internal combustion engine, but such a fuel injection valve can be also used for port injection.

The distal end portion, that is, the nozzle portion, of the fuel injection valve 10 has a nozzle body 12 as the valve body and a needle 14 as the valve member.

The nozzle body 12 has a valve seat 12*b* at a circular truncated conical surface 12*a* of a circular truncated cone shape that reduces in inner diameter toward the distal end thereof. The circular truncated conical surface 12*a* is the inner wall surface of the nozzle body 12. The nozzle body 12 has a sack portion 12*c* connected to the end portion on the distal end side of the circular truncated conical surface 12*a* of the nozzle body 12. The sack portion 12*c* is formed by the inner wall surface of the nozzle body 12. The sack portion 12*c* is constituted by a cylindrical surface 12*d* connected to the circular truncated conical surface 12*a* and a semispherical surface 12*e* connected to the cylindrical surface 12*d* on the side opposite that of the circular truncated conical surface 12*a*.

One end portion (first end portion) 16*a* of an injection hole 16 is opened in the sack portion 12*c*. In particular, the inlet end portion 16*a* of the injection hole 16 is opened at the semispherical surface 12*e* of the nozzle body 12 forming the sack portion 12*c*. The other end portion (second end portion) 16*b* of the injection nozzle 16 is opened at the outer wall 12*f* of the nozzle body 12. As a result, the injection hole 16 connects the sack portion 12*c* and the outer wall 12*f* of the nozzle body 12 through the nozzle body 12. The injection hole 16 extends obliquely to a central line of the nozzle body 12, that is, a central line A of the fuel injection valve 10. The injection hole 16 does not cross the central line A. Further, the injection nozzle 16 is formed in a slit-like shape. More specifically, the injection nozzle 16 has a flat slit-like shape. Further, the injection hole 16 is formed so as to expand in a circular sector shape from the inlet side toward the outlet side (see FIG. 2). Such injection hole 16 is formed to extend radially from the center of the sack portion 12*c*, more specifically, from the center of a sphere in the case where the sphere is determined to have the semispherical surface 12*e* as the surface thereof. Further, in the present embodiment, the fuel injection valve 10 is explained such that has only one injection hole 16, but the fuel injection valve can be also provided with a plurality of injection holes configured similarly to the injection hole 16. When a plurality of injection holes 16 is provided, the injection holes can be arranged and formed, for example, so as to have rotational symmetry about the central line A.

The needle 14 serving as the valve member is accommodated inside the fuel injection valve 10 so as to be capable of moving reciprocatingly along the central line A of the fuel injection valve 10 inside the nozzle body 12. The needle 14 is disposed substantially coaxially with the nozzle body 12. The needle 14 has a circular truncated conical surface 14*a* and a conical surface 14*b*. The connection portion of the circular truncated conical surface 14*a* and the conical surface 14*b* is a sealing portion 14*c* that can come into contact with the valve seat 12*b* of the nozzle body 12. The circular truncated conical surface 14*a* and the conical surface 14*b* form the outer wall surface of the needle 14.

The sealing portion 14*c* of the needle 14 can be seated on the valve seat 12*b* of the nozzle body 12. When the needle 14 is separated from the nozzle body 12, a seat opening 18 is formed between the outer wall surface of the needle 14 and the inner wall of the nozzle body 12. The fuel passage is opened by the formation of the seat opening 18. Therefore, in such fuel injection valve 10, where a coil (not shown in the figure) is energized and the needle 14 moves with respect to the nozzle body 12, the fuel supplied under the predetermined pressure to the fuel injection valve 10 is sprayed. In other words, the fuel injection valve 10 controls the supply of fuel to the sack portion 12*c* by the up-down movement (as shown in the figure) of the needle 14 and sprays the fuel downward (as shown in the figure) from the injection hole 16 opened in the sack portion 12*c*.

Further, a through hole 20 is formed in the nozzle body 12. One end portion (first end portion) 20*a* of the through hole 20 is opened in the sack portion 12*c*. In particular, the first end portion 20*a* of the through hole 20 is opened at a semispherical surface 12*e* of the nozzle body 12 forming the sack portion 12*c*. The other end portion (second end portion) 20*b* of the through hole 20 is opened at the outer wall 12*f* of the nozzle body 12. As a result, the through hole 20 connects the sack portion 12*c* with the outer wall 12*f* of the nozzle body 12 through the nozzle body 12. The through hole 20 is a small-diameter long straight hole with a round cross section. This hole is inclined with respect to a central line of the nozzle body 12, that is, the central line A of the fuel injection valve 10, but does not cross the central line A.

Such a through hole 20 is formed to extend through the injection hole 16. In other words, the through hole 20 is formed in accordance with the injection hole 16. The relationship between the injection hole 16 and the through hole 20 is explained below with reference to FIG. 3. When a plurality of injection holes 16 is provided, a plurality of through holes 20 is provided in accordance with the corresponding injection holes 16.

Figure 3:
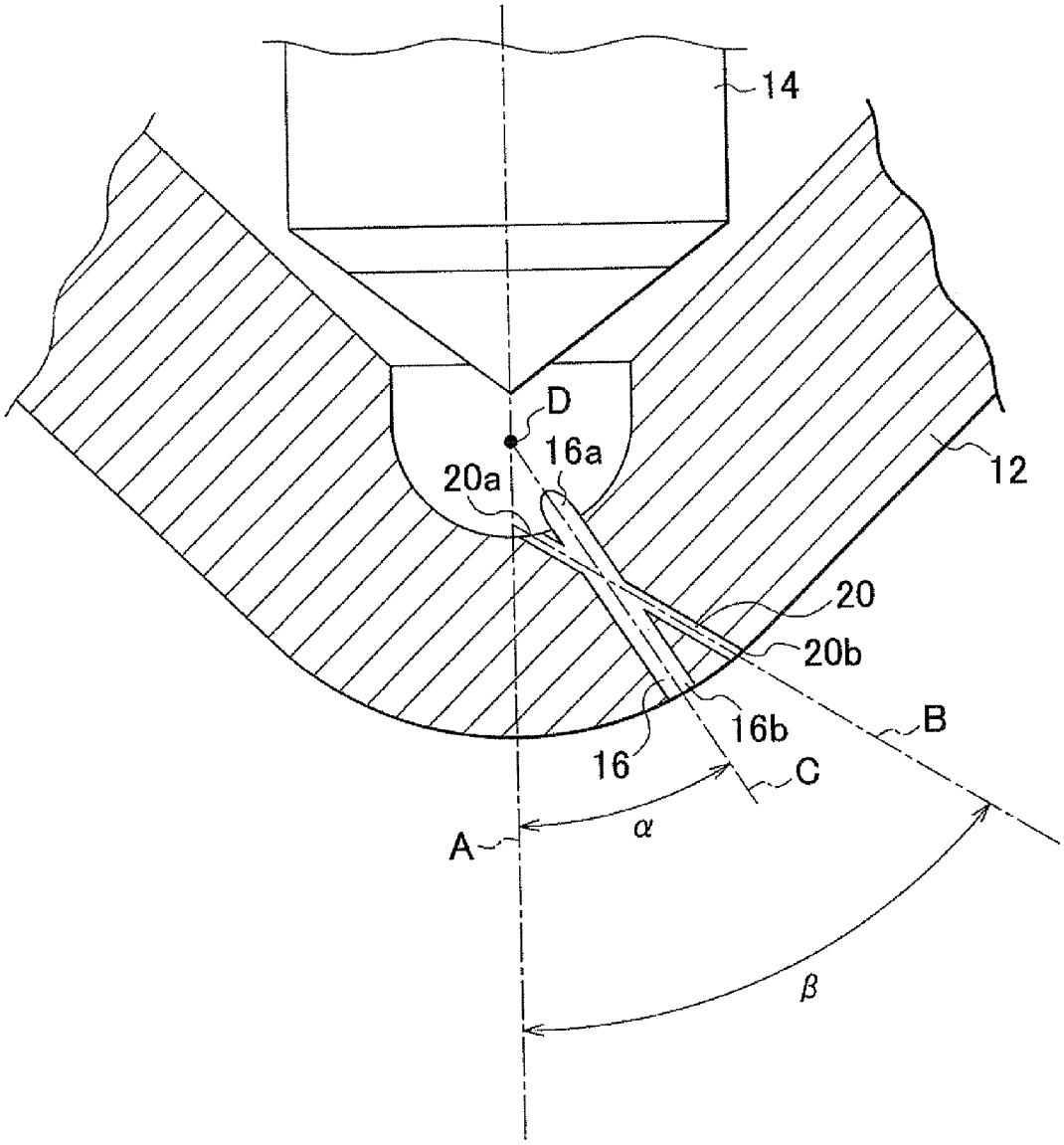
FIG. 3 is a schematic view of the distal end portion of the fuel injection valve shown in FIG. 1.

FIG. 3 represents schematically the fuel injection valve 10 in a plane (referred to hereinbelow as the first plane) that is defined so as to include the central line A of the fuel injection valve 10 and also defined so as to include an axial line B of the through hole 20. In this figure, only the nozzle body 12 is represented by the cross section thereof. FIG. 3 is similar to FIG. 1 except from the angles between the injection hole 16 and the through hole 20, and the central line A respectively. Then the line C extending along the injection hole 16 on the first plane is also shown in FIG. 3. In FIG. 3, the line C crosses the central line A at a point D. The point D is a center of the sack portion 12*c*, that is, the center of the sphere that defines the sphere having the semispherical surface 12*e* as the surface thereof. In the present embodiment, the injection hole 16 expands symmetrically with respect to the line C as a center. Therefore, the line C, which is not shown in FIG. 2, overlaps the central line A.

As follows from FIGS. 1 and 3, the first end portion 20*a* of the through hole 20 is positioned closer to the central line A of the fuel injection valve 10 than the first end portion 16*a* of the injection hole 16, and this relationship is also clearly visible on the first plane. Further, in the first plane, the injection hole 16 extends obliquely to the central line A so that the first end portion 16*a* of the injection hole 16 is closer to the central line A of the fuel injection valve 10 than the second end portion 16*b* of the injection hole 16. This corresponds to the injection hole 16 being formed so as to extend radially from the center of the sack portion 12*c*. Therefore, in the first plane, the angle $\alpha$ formed by the (line C of the) injection hole 16 and the central line A of the fuel injection valve 10 is less than the angle $\beta$ formed by the (axial line B of the) through hole 20 and the central line A of the fuel injection valve 10.

Figure 4:
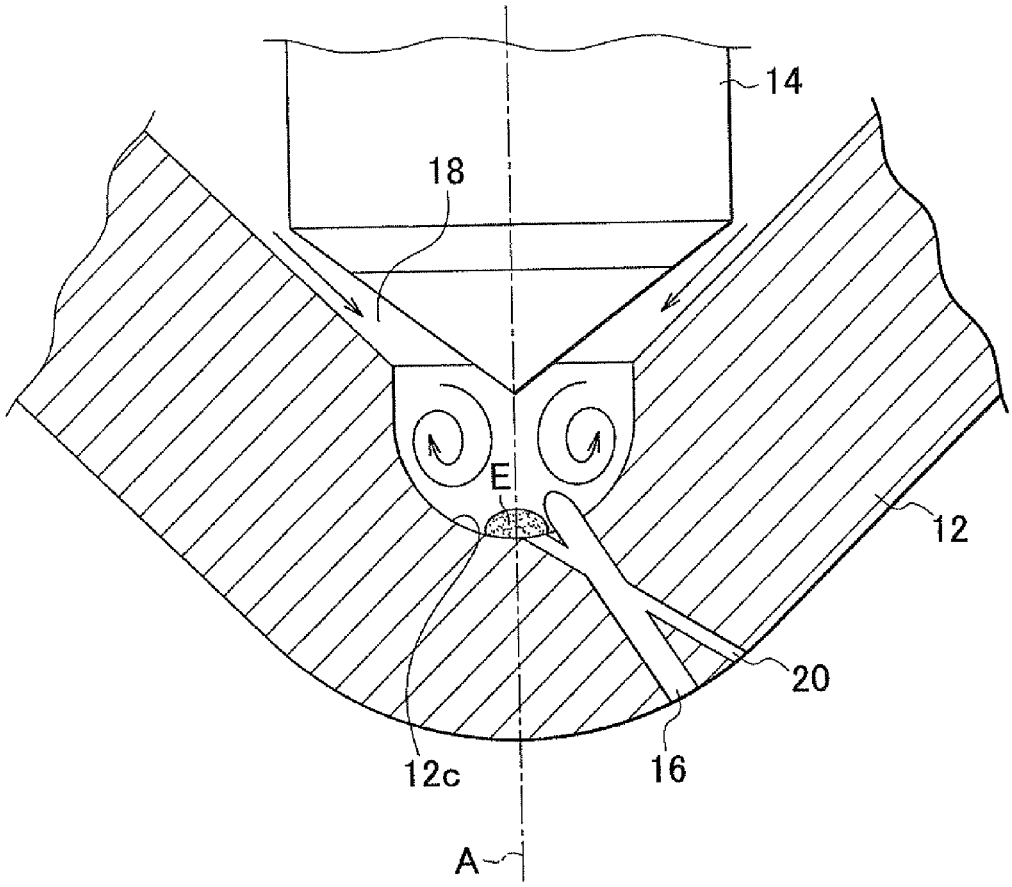
FIG. 4 is a schematic view of the distal end portion of the fuel injection valve shown in FIG. 1.
Figure 5:
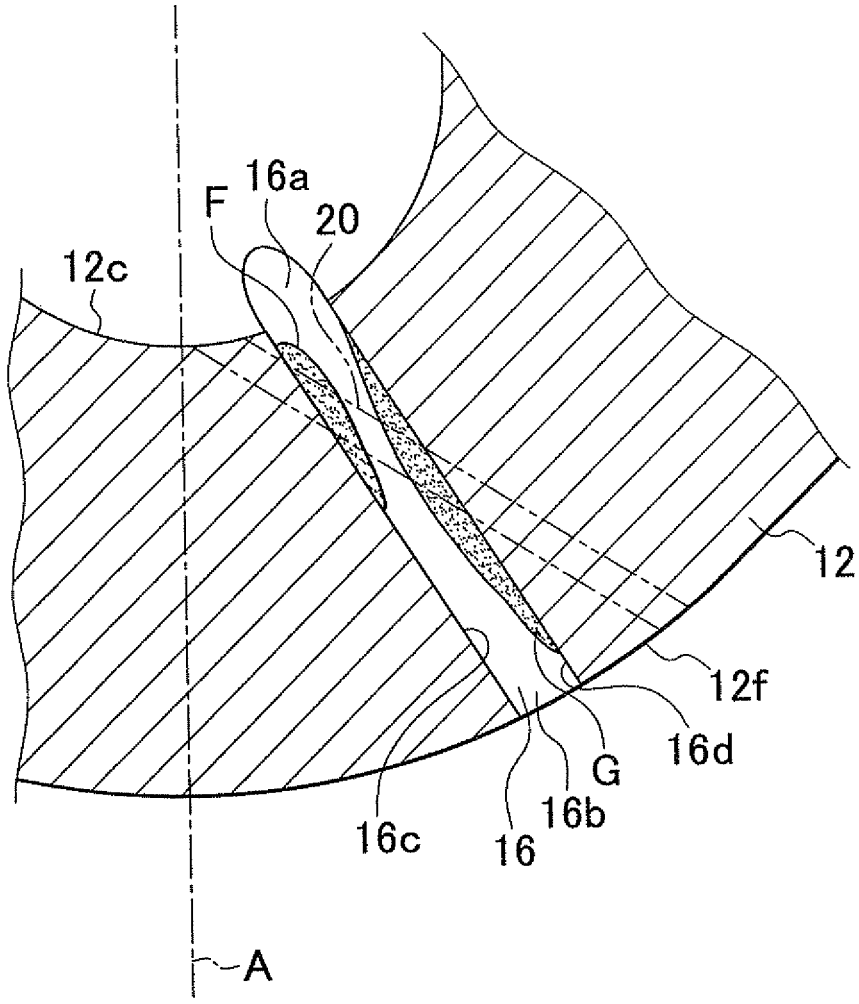
FIG. 5 is an enlarged schematic view illustrating the relationship between the through hole and a cavitation generation region in the injection hole in the fuel injection valve shown in FIG. 1.

The relationship between the injection hole 16 and the through hole 20 will be further explained below with reference to FIGS. 4 and 5. FIGS. 4 and 5 represent schematically the test results obtained when the flow of fuel in the fuel injection valve 10 shown in FIGS. 1 to 3 was studied. The flow of fuel and cavitation generation region are represented schematically in the figures. In FIG. 5, the cavitation generation region inside the injection hole 16 is shown, and the through hole 20 is represented by virtual lines.

As mentioned hereinabove, where fuel injection is performed, the seat opening 18 is formed and the fuel passage is opened when the needle 14 is separated from the nozzle body 12. As a result, the fuel that has passed through the seat opening 18 is initially introduced into the sack portion 12*c*. The seat opening 18 is formed in a ring-like shape and the sack portion 12*c* has the semispherical surface 12*e*. Therefore, the fuel forms a vortex, as shown schematically in FIG. 4, inside the sack portion 12*c*. This vortex is formed in a substantially ring-like shape around the central line A. The fuel located inside the sack portion 12*c* then flows into the injection hole 16. The formation of the vortex inside the sack portion 12*c* causes separation of the fuel flow in the vicinity of the semispherical surface 12*e* of the sack portion 12*c*, in particular close to the central line A, and a negative pressure is generated. The region where the negative pressure is generated, that is, the negative pressure generation region is represented schematically as a region E in FIG. 4. As clearly shown in the figure, the first end portion 20*a* of the through hole 20 is opened in the region E in the vicinity of the central line A of the semispherical surface 12*e* of the sack portion 12*c*.

Meanwhile, the fuel that flows from the sack portion 12*c* into the injection hole 16 is throttled in the relatively narrow first end portion 16*a*, that is, the inlet portion, and immediately after the pressure thereof has been increased, flows into the injection hole 16, whereby the pressure thereof drops instantaneously. Therefore, cavitation is generated inside the injection hole 16. Such an effect is remarkable in the circular sector-shaped slit-like injection hole 16. However, an offset occurs in the cavitation generation region inside the injection hole 16. FIG. 5 shows schematically the cavitation generation region inside the injection hole 16 in the first plane. The cavitation generation region F in the vicinity of a wall surface 16*c* on one side from the central line in the injection hole 16 is offset to the first end portion 16*a*, that is, to the inlet side. By contrast, the cavitation generation region G in the vicinity of a wall surface 16*d* on the other side from the central line in the injection hole 16 expands within a wide range as far as the center of the injection hole 16. This is the result of the injection hole 16 being formed obliquely, as described hereinabove, to the central line A of the fuel injection valve 10 and of the fuel flowing in different modes from the sack portion 12*c* to the injection hole 16 on the wall surface 16*c* on one side from the central line and the wall surface 16*d* on the other side of the central line. Further, as shown in FIG. 5, the through hole 20 that is opened in the negative pressure generation region E or a vicinity thereof inside the sack portion 12*c* as described hereinabove extends through these cavitation generation regions F, G of the injection hole 16.

Because the fuel injection valve 10 is provided with such a through hole 20, the fuel injection valve 10 demonstrates excellent deposit removal capability. For example, in a state in which cavitation is generated inside the injection hole 16, a high negative pressure is additionally introduced from inside the sack portion 12*c* into the injection hole 16 via the through hole 20. Therefore, strong cavitation is generated inside the injection hole 16, and even if deposits have been formed in the injection hole 16, stripping of the deposits is actively enhanced and the inside of the injection hole 16 is effectively removed. Meanwhile, in a state in which cavitation is typically unlikely to occur inside the injection hole 16, for example, when the fuel injection pressure is low or during the open-close transition period of the fuel injection valve 10, the negative pressure from the sack portion 12*c* is introduced into the injection hole 16. Therefore, in either state, the removal of deposits present inside the injection hole 16 is implemented.

Such an introduction of negative pressure from the interior of the sack portion 12*c* into the injection hole 16 advances the atomization of the injected fuel from the fuel injection valve 10. As a result, fuel volatilization ability inside the internal combustion engine is improved and fuel combustibility is improved. Therefore, in an internal combustion engine provided with the fuel injection valve 10, exhaust emission can be improved and the fuel can be prevented from admixing to the oil.

Figure 6:
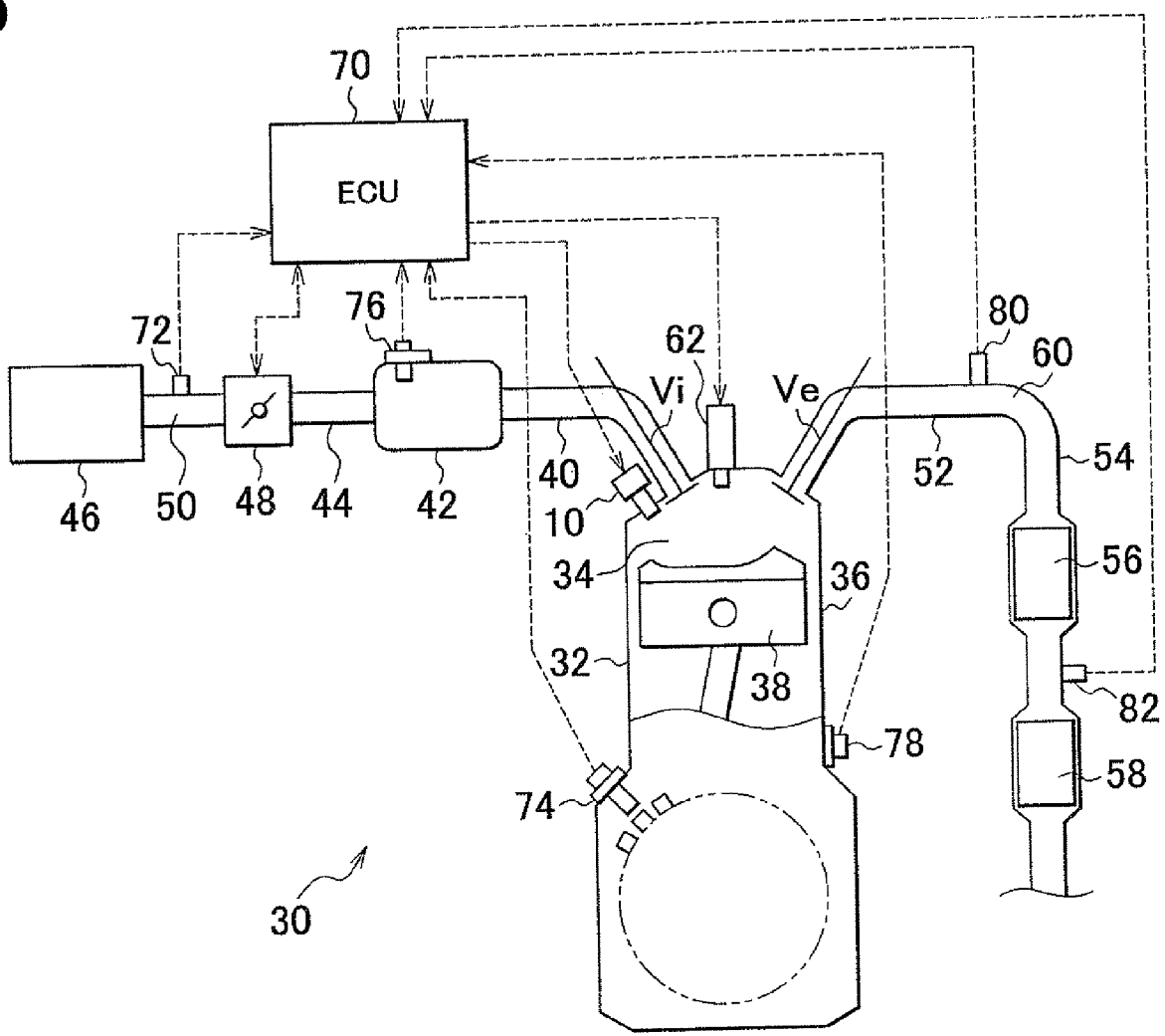
FIG. 6 is a schematic diagram of the internal combustion engine provided with the fuel injection valve shown in FIG. 1.

Further, the above-described fuel injection valve 10 is mounted on the internal combustion engine 30. FIG. 6 shows a schematic configuration of the internal combustion engine 30 provided with the fuel injection valve 10. In the internal combustion engine 30 shown in the figure, the fuel injection valve 10 is provided at the cylinder head adjacently to a corresponding combustion chamber 34 formed in a cylinder block 32. The mixture of air and fuel injected and supplied from the fuel injection valve 10 directly into the combustion chamber 34 is burned in the combustion chamber 34, thereby causing the piston 38 to move reciprocatingly inside a cylinder 36. As a result, the internal combustion engine 30 generates power. FIG. 6 shows only one cylinder, but the internal combustion engine 30 is provided with a plurality of cylinders. The fuel injection valve 10 can be also used in a single-cylinder engine.

An intake port adjacent to each combustion chamber 34 is opened and closed by an intake valve Vi and connected to an intake manifold 40. A surge tank 42 and the intake pipe 44 are connected, in the order of description, upstream of the intake manifold 40. The intake pipe 44 is connected to an air take-in port (not shown in the figure) via an air cleaner 46. An electronically controlled throttle valve 48 is installed in the intermediate section (between the surge tank 42 and the air cleaner 46) of the intake pipe 44. These components, for example, the intake port, intake manifold 40, surge tank 42, and intake pipe 44 each form a section of an intake passage 50.

An exhaust port adjacent to each combustion chamber 34 is opened and closed by an exhaust valve Ve, connected to an exhaust manifold 52. An exhaust pipe 54 is connected on a downstream side to the exhaust manifold 52. A pre-catalytic device 56 including a three-way catalyst and a post-catalytic device 58 including a NOx absorption and reduction catalyst are connected to the exhaust pipe 54. These components, for example, the exhaust port, exhaust manifold 52, and exhaust pipe 54 each form a section of an exhaust passage 60.

Each cylinder 36 of the internal combustion engine 30 has a sparkplug 62. Each sparkplug 62 is provided in a cylinder head so as to be close to the corresponding combustion chamber 34.

The above-described fuel injection valves 10, throttle valve 48, sparkplugs 62 and the like are electrically connected to an electronic control unit (referred to hereinbelow as ECU) 70 that functions substantially as a controller of the internal combustion engine 30. The ECU 70 includes a central processing unit (CPU), a read only memory (ROM), a random access memory (RAM), an input/output (I/O) port (not shown in the figure) and the like. Various sensors are electrically connected via analog/digital (A/D) converters or the like to the ECU 70. For example, an flowmeter 72 for detecting an intake air amount is connected. The ECU 70 controls the operation of the fuel injection valves 10, throttle valve 48, sparkplugs 62 and the like so as to obtain the desired output by using various maps stored in a storage device such as a ROM and on the basis of detection values obtained by using various sensors.

As shown in FIG. 6, a crank position sensor 74 is one of the sensors connected to the ECU 70. The crank position sensor 74 is also used as an engine revolution speed sensor in the internal combustion engine 30. Moreover, an intake pressure sensor 76 for detecting a pressure of the intake passage 50, in other words, an intake pressure, is provided. Further, a water temperature sensor 78 for detecting the temperature of cooling water in the internal combustion engine 30, an accelerator position sensor (not shown in the figure) for detecting the depression amount of the accelerator pedal, and a throttle position sensor for detecting an opening degree of the throttle valve 48 are also provided. Further, a vehicle speed sensor (not shown in the figure) for detecting the speed of the vehicle (vehicle speed) where the internal combustion engine 30 is installed is also provided. Furthermore, an air/fuel ratio sensor (A/F sensor) 80 is also provided in the exhaust passage 60. The A/F sensor 80 outputs to the ECU 70 an electric signal corresponding to the air/fuel ratio in the exhaust gas in the exhaust passage 60. An $O_2$ sensor 82 is also provided in the exhaust passage 60. The $O_2$ sensor 82 outputs to the ECU 70 an electric signal overspending to the concentration of oxygen in the exhaust gas.

The ROM of the ECU 70 stores a routine for fuel injection control, a v for ignition timing control, a routine for throttle valve control, and data, such as map, used in these routines. The ECU 70 implements the fuel injection control, ignition control, and throttle control according to the application programs such as the abovementioned routines stored in the ROM or the like. In other words, the ECU 70 is provided with functions of fuel injection control means, ignition timing control means, and throttle control means. In addition, as will be described hereinbelow, the ECU 70 is also provided with functions of deposit formation determination means for determining whether or not deposits have been formed in the fuel injection valve 10 and fuel determination means for determining whether or not a heavy fuel is used as the fuel.

For example, the ECU 70 implements the fuel injection control on the basis of data or the like that have been stored in advance so as to obtain a predetermined or desired operation state. For example, in the fuel injection control, the movement amount of the needle 14 with respect to the nozzle body 12 is controlled and also the pressure of fuel supplied to the fuel injection valve 10, that is, the fuel pressure, is subjected to variable control according to the load. In a low-load operation region, the required fuel injection amount is relatively small and therefore the fuel pressure is made lower than the fuel pressure in a high-load operation region. Further, in the event of cold start, the ECU 70 performs a catalyst warm-up control. Whether or not a cold start is performed, can be determined by whether or not the cooling water temperature is less than a predetermined temperature. When the cooling water temperature is less than the predetermined temperature, fuel injection control is performed on the basis of data for cold divided injection mode. More specifically, divided injection is performed by which fuel is injected from the fuel injection valve 10 in the intake stroke and compression stroke. As a result, the so-called after-burning occurs, the exhaust gas temperature is thereby increased and the warm-up enhancing action is intensified. When the divided injection for catalyst warm-up is performed, the injection period may be delayed by a predetermined angle, that is, the ignition period delay control may be performed.

Figure 7:
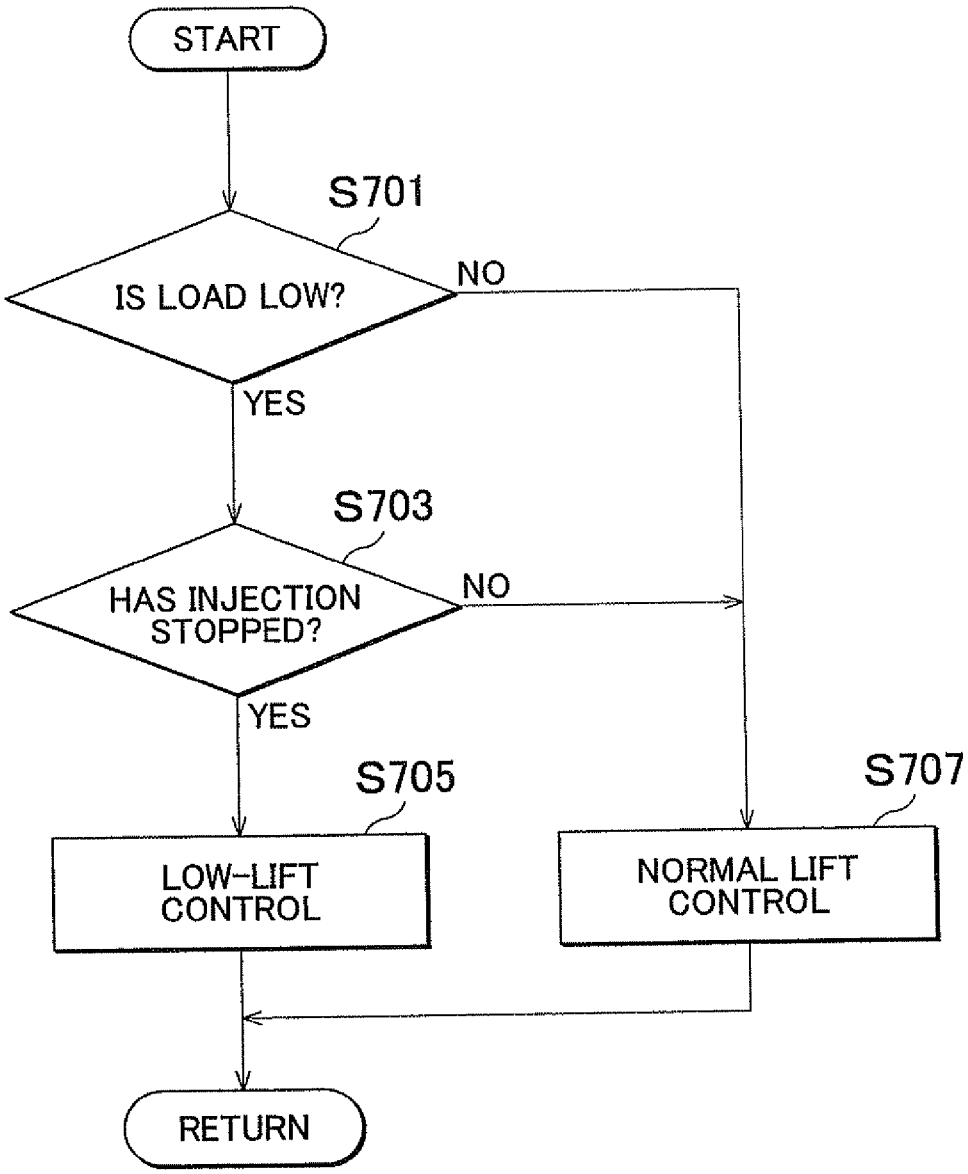
FIG. 7 is a flowchart illustrating an example of fuel injection control in the internal combustion engine shown in FIG. 6.

However, in some cases, the transition to the predetermined or desired state does not occur even when the control aimed at the implementation of such a transition is performed on the basis of the preset data or the like. For example, when deposits are formed in the fuel injection valve 10 and fuel injection is not adequately performed, the transition to the predetermined operation state does not proceed smoothly. In such a case, the ECU 70 performs a control for removing the deposits in the fuel injection valve 10 (referred to hereinbelow as cleaning control). The cleaning control will be explained below with reference to the flowchart shown in FIG. 7.

First, the ECU 70 determines whether or not the operation state is in a low-load operation region (step S701). This can be done, for example, on the basis of output of the air flowmeter 72, accelerator position sensor, or the like. In the case of low-load operation (positive determination in step S701), it is determined whether or not fuel injection from the fuel injection valve 10 has been stopped (step S703). For example, when a transition to the predetermined operation state did not take place for a predetermined time, the ECU 70 determines that fuel injection has stopped, that is, that deposits have been formed in the fuel injection valve 10 and therefore adequate fuel injection has not been performed (positive determination in step S703). In other words, this determination (step S703) corresponds to the determination as to whether or not deposits have been formed in the fuel injection valve 10. For example, when adequate fuel injection is not performed, the air/fuel ratio of the exhaust gas is unlikely to match the predetermined air/fuel ratio. Therefore, the aforementioned determination can be performed on the basis of output of the A/F sensor 80 and $O_2$ sensor 82. The determination in steps S701 and S703 may be also performed on the basis of output from other sensors (detection means).

Figure 8:
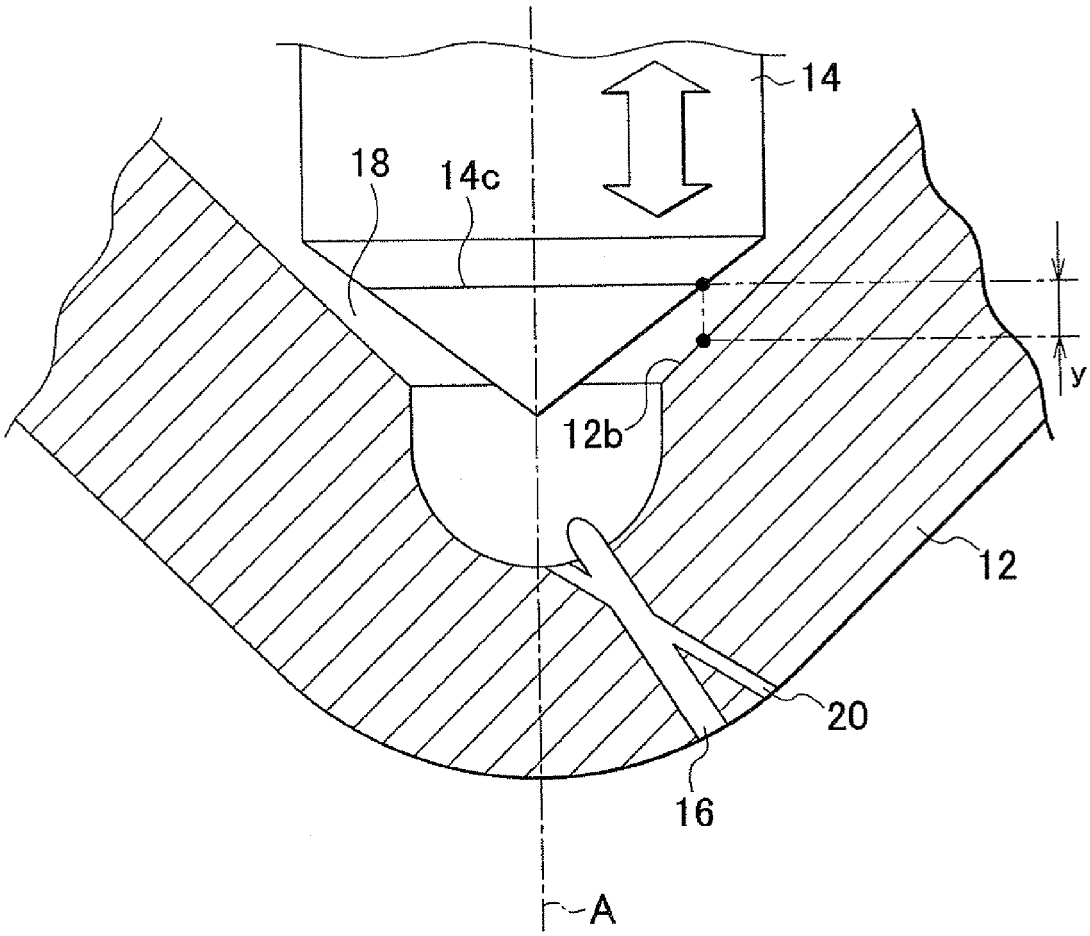
FIG. 8 is a schematic diagram illustrating the lift of the valve member with respect to the valve body in the fuel injection valve shown in FIG. 1.

When the ECU 70 determines that fuel injection has been stopped (positive determination in step S703), low-lift control is implemented as cleaning control to remove the deposits from the fuel injection valve 10 (step S705). In the cleaning control, the movement amount, that is, the lift amount, of the needle 14 with respect to the nozzle body 12 at the time of fuel injection is made less than the lift amount in the fuel injection control during normal operation. As shown in FIG. 8, the movement amount, that is, the lift amount $\gamma$, of the needle 14 with respect to the nozzle body 12 is the distance in the direction of the central line A between the valve seat 12*b* of the nozzle body 12 and the sealing portion 14*c* of the needle 14.

The position of the needle 14 relative to the nozzle body 12 will be explained below. When fuel injection is not performed, the needle 14 is moved to the position (closed position) at which the needle is seated on the nozzle body 12. When fuel injection is performed under the ordinary fuel injection control, the needle 14 is moved from the closed position to a predetermined position (high-lift position) at which the surface area of the ring-shaped seat opening 18 formed between the valve seat 12*b* and the sealing portion 14*c* separated from the valve seat 12*b* is equal to or greater than the opening area (may be minimum opening area) of the first end portion of the injection hole 16. By contrast, during fuel injection in which low-lift control (step S705) is performed as the cleaning control, the needle 14 is moved from the closed position to a predetermined position (low-lift position) at which the area of the seat opening 18 is less than the opening area of the first end portion of the injection hole 16. The needle 14 is thus selectively positioned at the closed position, high-lift position (non-cleaning position), and low-lift position (cleaning position). The high-lift position may be a single predetermined position, but is used herein to define a set including a plurality of different predetermined positions.

The area of the seat opening 18 is generally determined by multiplying the length of the sealing portion 14*c* by the lift amount $\gamma$. In the present embodiment, since a single injection hole 16 is provided, the opening area of the first end portion of the injection hole 16 is an opening area of the first end portion of the single injection hole 16. However, in a fuel injection valve provided with a plurality of injection holes 16, the opening area of the first end portion of the injection 16 which is contrasted against the area of the seat opening 18 is a sum total of opening areas of the first end portions of all of the injection holes 16. In other words, it is the opening area of the first end portions of all of the injection holes 16 that is contrasted against the area of the seat opening 18.

When deposits have been formed in the fuel injection valve 10, such fuel injection performed by moving the needle 14 to the low-lift position makes it possible to enhance actively the removal of deposits from the fuel injection valve 10. Where a small lift amount γ is set, the area of the seat opening 18 is reduced and the level of negative pressure generated inside the sack portion 12*c* can be increased. Therefore, even in the case of a light load when the fuel pressure is relatively low, a high negative pressure can be introduced into the injection hole 16 via the through hole 20, cavitation can thus be actively induced inside the injection hole 16, and peeling of deposits can be actively enhanced. In a fuel injection valve that has no through hole 20, such a transition to a low-lift mode increases pressure loss in the injection hole 16. Therefore, the position of the needle 14 cannot be located at the low-lift position.

Meanwhile, when the operation state is not in the low-load operation region (negative determination in step S701) or fuel injection has not stopped (negative determination in step S703), the ordinary fuel injection control (ordinary lift control) is implemented (step S707). In this case, fuel injection can be implemented by positioning the needle 14 at the high-lift position.

Figure 9:
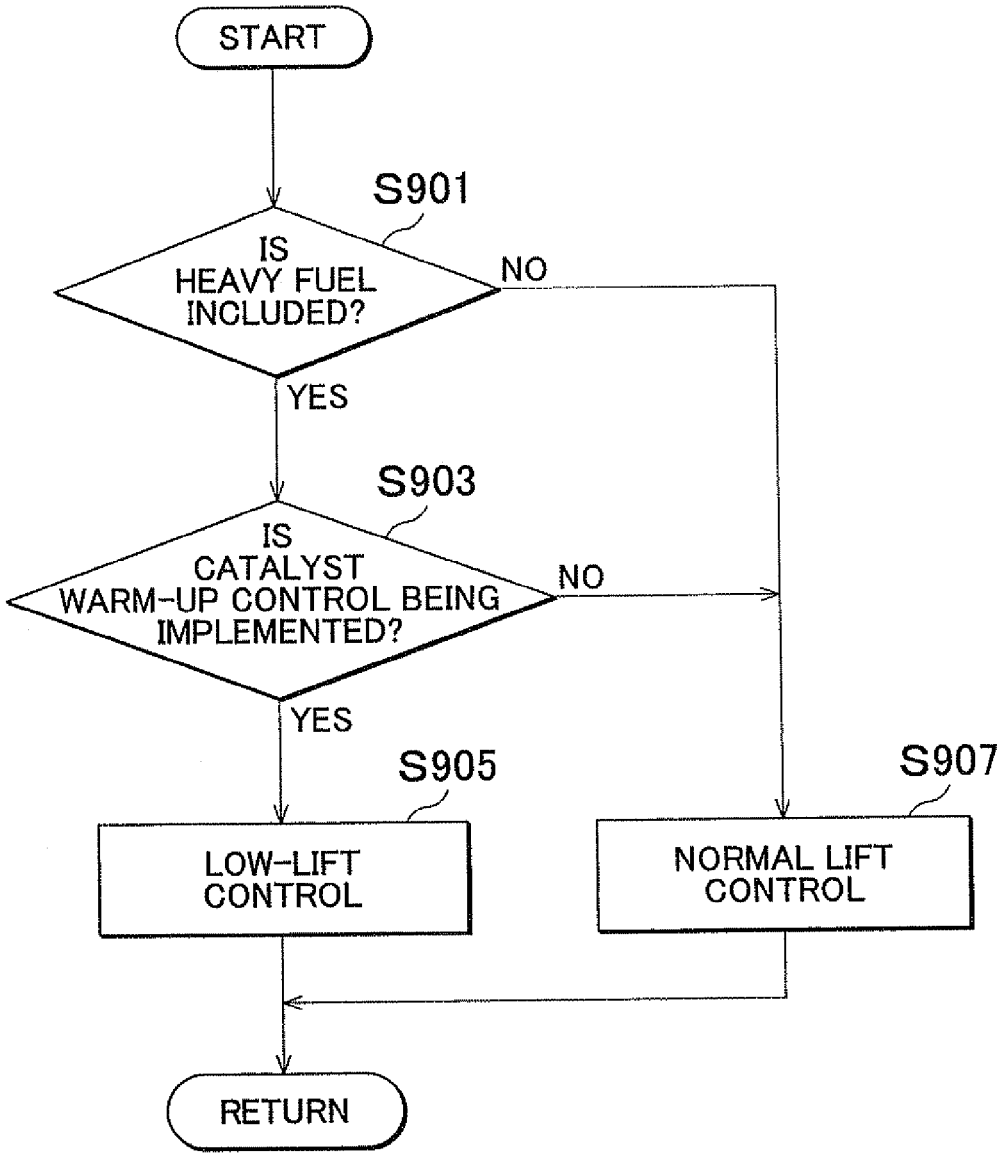
FIG. 9 is a flowchart illustrating another example of fuel injection control in the internal combustion engine shown in FIG. 6.

The above-described case is not the only one in which the cleaning of the fuel injection valve 10 in the internal combustion engine 30 is desirable. More specifically, when heavy fuel is used as the fuel, deposits are easily formed in the fuel injection valve 10. Accordingly, cleaning of the fuel injection valve 10 is actively relied upon when heavy fuel is used. Such cleaning control will be explained below with reference to the flowchart shown in FIG. 9. The heavy fuel is a fuel with low volatility and includes, for example, a heavy oil.

The ECU 70 determines whether or not the fuel includes a heavy fuel (step S901). When the heavy fuel is used, variations in the engine revolution speed increase. Therefore, it is determined whether or not the variation amount of engine revolution speed is equal to or higher than a predetermined amount. Further, since a heavy fuel has low volatility, when a heavy fuel is used, the fuel injection amount during cold start is substantially less than that when a light fuel such as gasoline (petrol) is used. As a result, when a heavy fuel is used as the fuel, the combustion of air-fuel mixture can be different and the air/fuel ratio can be different from those in the case where a light fuel is used. Therefore, whether or not the fuel includes a heavy fuel can be determined, for example, on the basis of engine revolution speed and air/fuel ratio of exhaust gas, that is, on the basis of the output of at least any one of the crank position sensor 74, A/F sensor 80, and $O_2$ sensor 82.

When a heavy fuel is included in the fuel (positive determination in step S901), it is determined whether or not a catalyst warm-up control is being performed (step S903). Whether or not a catalyst warm-up control is being performed may be determined on the basis of cooling water temperature. When the ECU 70 performs divided injection in which fuel is injected from the fuel injection valve 10 in the intake stroke and compression stroke, as described herein above, it is determined that the catalyst warm-up control is being performed.

Where it is determined that the catalyst warm-up control is being performed (positive determination in step S903), the ECU 70 sets the lift amount γ of the needle 14 to a lift amount corresponding to the cleaning position. In other words, low-lift control is implemented in which fuel injection is performed by moving the needle 14 to the low-lift position (step S905).

As a result, in the intake stroke, since the internal cylinder pressure is negative, a negative pressure can be actively introduced into the through hole 20 and cleaning inside the through hole 20, such as removal of deposits located inside the through hole 20, can be actively performed. By contrast, in the compression stroke, since the internal cylinder pressure is increased, a negative pressure is actively introduced into the injection hole 16 and cleaning inside the injection hole 16, such as removal of deposits located inside the injection hole 16, can be actively performed. Therefore, both the through hole 20 and the injection hole 16 can be cleaned by performing fuel injection by moving the needle 14 to the low-lift position during the catalyst warm-up control.

Meanwhile, when no heavy fuel is contained in the fuel (negative determination in step S901) or when the catalyst warm-up control is not performed (negative determination in step S903), the ordinary fuel injection control (ordinary lift control) is implemented (step S907). In this case, fuel injection is implemented by positioning the needle 14 at the high-lift position.

The embodiments of the invention are described above, but other various embodiments of the invention can be considered. For example, in the above-described embodiments, the injection hole has a circular sector-shape slit-like form, but other forms may be also used. For example, the injection hole may have a triangular shape. Further, the cross-sectional shape of the through hole is not limited to a circle and may be an ellipse, a rectangle, or a polygon. The first end portion of the through hole may be positioned on the central line of the fuel injection valve. Further, the above-described internal combustion engine is a simple direct-injection engine, but the invention can be also applied to a dual-injection engine that is provided with a fuel injection valve for port injection in addition to the above-described cylinder injection valve. The embodiments also include the configuration in which the fuel injection valve in accordance with the invention is used as a fuel injection valve for port injection. The fuel used is not limited to gasoline (petrol), and the invention can be also applied to fuel injection valves or internal combustion engine using various other fuels, for example, alcohol fuels.

While the invention has been described with reference to example embodiments thereof, it is to be understood that the invention is not limited to the described embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the scope of the invention.

What is claimed is:

1. A fuel injection valve that controls fuel supply by a movement of the valve member relative to a valve body, comprising:

a slit-like injection hole having a first end portion opened in a sack portion of the valve body and a second end portion opened at an outer wall of the valve body; and a through hole having a first end portion opened in the sack portion and a second end portion opened at the outer wall of the valve body, the through hole extending through the injection hole.

2. The fuel injection valve according to claim 1, wherein the injection hole is formed to extend radially from a center of the sack portion.

3. The fuel injection valve according to claim 1, wherein the through hole is formed linearly.

4. The fuel injection valve according to claim 1, wherein:

the injection hole is formed obliquely to a central line of the fuel injection valve; and the first end portion of the through hole is positioned closer to the central line of the fuel injection valve than the first end portion of the injection hole.

5. The fuel injection valve according to claim 1, wherein:

the injection hole is formed such that the first end portion of the injection hole is located closer to the central line of the fuel injection valve than the second end portion of the injection hole in a plane that is defined so as to include the central line of the fuel injection valve and an axial line of the through hole; and in the plane, an angle formed by the injection hole and the central line of the fuel injection valve is less than an angle formed by the through hole and the central line of the fuel injection valve.

6. The fuel injection valve according to claim 1, wherein:

the valve member is selectively positioned at a closed position in which the valve member is seated on the valve body, a high-lift position in which an area of a seat opening which is formed between the valve body and the valve member separated from the valve body is equal to or greater than an opening surface area of the first end portions of all of the injection holes, and a low-lift position in which the area of the seat opening portion is less than the opening area of the first end portions of all of the injection holes.

7. An internal combustion engine, comprising:

the fuel injection valve according to claim 1.

8. The internal combustion engine according to claim 7, wherein a fuel injection control unit that is configured to control an operation of the fuel injection valve performs fuel injection by selectively moving the valve member to a closed position in which the valve member is seated on the valve body, a high-lift position in which an area of a seat opening portion which is formed between the valve body and the valve member separated from the valve body is equal to or greater than an opening area of the first end portions of all of the injection holes, and a low-lift position in which the area of the seat opening portion is less than the opening area of the first end portions of all of the injection holes.

9. The internal combustion engine according to claim 8, further comprising:

a deposit formation determination unit that is configured to determine whether or not deposits have been formed on the fuel injection valve; and the fuel injection control unit performs fuel injection by moving the valve member to the low-lift position when deposits are determined to have been formed by the deposit formation determination unit.

10. The internal combustion engine according to claim 8, further comprising:

a fuel determination unit that is configured to determine whether or not heavy fuel is used as the fuel; and the fuel injection control unit performs fuel injection by moving the valve member to the low-lift position when heavy fuel is determined to have been used by the fuel determination unit.

* * * * *